United States Patent [19]

Reiss et al.

[11] Patent Number: 4,672,022

[45] Date of Patent: Jun. 9, 1987

[54] RADIATION-SENSITIVE PRINTING PLATES WITH BASE WHICH CONSISTS OF AN ALUMINUM ALLOY HAVING IRON AND MANGANESE

[75] Inventors: Kurt Reiss, Weisbaden; Walter Niederstätter, Eltville, both of Fed. Rep. of Germany

[73] Assignee: Hoechst Aktiengesellschaft, Frankfurt am Main, Fed. Rep. of Germany

[21] Appl. No.: 753,133

[22] Filed: Jul. 9, 1985

[30] Foreign Application Priority Data

Jul. 13, 1984 [DE] Fed. Rep. of Germany ..... 3425860

[51] Int. Cl.[4] ..... G03C 1/94

[52] U.S. Cl. ..... 430/278; 430/157; 430/165; 430/275; 430/276; 430/302

[58] Field of Search ..... 430/302, 278, 276, 275, 430/165, 157

[56] References Cited

U.S. PATENT DOCUMENTS

| | | | |
|---|---|---|---|
| 3,672,878 | 6/1972 | Teubler et al. | 75/141 |
| 3,717,915 | 2/1973 | Teubler et al. | 29/197.5 |
| 3,811,894 | 3/1974 | Yonezaua et al. | 430/165 |
| 3,826,651 | 7/1974 | Weber et al. | 430/276 |
| 3,989,548 | 11/1976 | Morris | 148/2 |
| 4,211,619 | 7/1980 | Usbeck | 204/33 |
| 4,292,388 | 9/1981 | Ikeda et al. | 430/299 |
| 4,301,229 | 11/1981 | Sakaki et al. | 430/158 |
| 4,331,479 | 5/1982 | Toyoma | 430/147 |
| 4,383,897 | 5/1983 | Gillich et al. | 204/33 |
| 4,435,230 | 3/1984 | Fujikura | 148/11.5 A |
| 4,476,006 | 10/1984 | Ohba et al. | 430/278 |
| 4,554,057 | 11/1985 | Mohr | 430/278 |
| 4,581,996 | 4/1986 | Platzer | 430/302 |

FOREIGN PATENT DOCUMENTS

| | | |
|---|---|---|
| 0067056 | 12/1982 | European Pat. Off. . |
| 0067632 | 12/1982 | European Pat. Off. . |
| 0096347 | 12/1983 | European Pat. Off. . |
| 0097318 | 1/1984 | European Pat. Off. . |

*Primary Examiner*—Charles L. Bowers, Jr.

*Attorney, Agent, or Firm*—Schwartz, Jeffery, Schwaab, Mack, Blumenthal & Evans

[57] ABSTRACT

An aluminum alloy suitable as a base for printing plates consists essentially of aluminum containing iron (Fe) and manganese (Mn), the Fe content being 1.2 to 2.1% by weight, the Mn content being 0.1 to 0.9% by weight and the sum of the Fe and Mn contents being 1.3 to 2.2% by weight. A printing plate can be produced with such a base, the base being mechanically, chemically and/or electrochemically roughened and if required, anodically oxidized and hydrophilized. The printing plate includes at least one radiation-sensitive reproduction layer applied on the base.

4 Claims, No Drawings

RADIATION-SENSITIVE PRINTING PLATES WITH BASE WHICH CONSISTS OF AN ALUMINUM ALLOY HAVING IRON AND MANGANESE

BACKGROUND OF THE INVENTION

The invention relates to a base for printing plates which consists of a particular aluminum alloy containing iron and manganese, and a printing plate containing such a base and at least one reproduction layer.

Radiation-sensitive or photosensitive reproduction layers are used, for example, in the production of offset printing plates and photoresists, i.e., they are generally applied onto a base by the user or by the industrial manufacturer. The bases employed in these copying materials are metals such as zinc, magnesium, chromium, copper, brass, steel, silicon, aluminum or combinations of these metals, plastic films, paper or similar materials. While these bases can be coated with the radiation-sensitive reproduction layer without being subjected to a modifying pretreatment, preferably they are coated after surface modification, such as by mechanical, chemical and/or electrochemical roughening, by oxidation and/or by treatment with hydrophilizing agents. Hydrophilizing agents are particularly used in the case of bases for offset printing plates constructed of aluminum or one of its alloys. The usual radiation-sensitive reproduction layers contain not only at least one radiation-sensitive compound, but in general also contain an organic binder, such as a resin, and if appropriate, plasticizers, pigments, dyes, wetting agents, sensitizers, adhesion promoters, indicators and other conventional additives. These reproduction layers are irradiated (i.e., exposed) and then developed in order to produce an image. A printing plate may, for example, be obtained in this manner.

The aluminum alloys described below are among the materials disclosed in the prior art for use in printing plates, the alloys mentioned in the first three references being commercial products available on the European, American and/or Japanese market.

| Alloy designation/ reference | Composition of the alloy in % by weight of (remainder is Al) | | | | | | | | |
|---|---|---|---|---|---|---|---|---|---|
| | Si | Cu | Mn | Mg | Cr | Zn | Fe | Ti | Others |
| "1100" | 0.375 | 0.05 | — | — | — | — | 0.375 | — | — |
| "3003" | 0.2 | 0.05 | 0.7 | — | — | 0.2 | 0.15 | 0.2 | — |
| "A 19" | 0.375 | 0.05 | — | 0.9 | — | — | 0.375 | — | — |
| US-A 4 383 897 | | | | | | | | | |
| "Pure aluminum" (DIN material 3.0255) | 0.3 | 0.02 | — | — | — | 0.07 | 0.4 | 0.03 | 0.03[1] |
| "DIN material 3.0515" | 0.5 | 0.1 | 0.8–1.5 | 0–0.3 | — | 0.2 | 0.5 | 0.2 | 0.15[2] |
| EP-B 0 004 569 (= US-A 4 211 619) | | | | | | | | | |
| "1S" | 0.25 | — | — | — | — | — | — | — | — |
| "2S" | 0.4 | — | — | 0.6 | — | — | — | — | — |
| "3S" | — | — | 1.2 | — | — | — | — | — | — |
| "24S" | — | 4.5 | 0.6 | 1.5 | — | — | — | — | — |
| "52S" | — | — | — | 2.5 | 0.25 | — | — | — | — |
| "61S" | 0.6 | 0.25 | — | 1.0 | 0.25 | — | — | — | — |
| "75S" | — | 1.60 | — | 2.50 | 0.30 | 5.60 | — | — | — |
| DE-A 29 12 060 (= US-A 4 301 229) | | | | | | | | | |
| DE-B 11 60 639 | 0.8–1.2 | 1.4–1.6 | 0.5–0.9 | 0.8–1.2 | — | 0.1–0.3 | 0.5 | — | — |
| DE-A 19 29 146 (= US-A 3 672 878 and 3 717 915 | 0.2–0.4 | 0.05–0.3 | 0.8–1.4 | 0.8–2.5 | — | 0.01–0.2 | 0.2–0.6 | 0.01–0.05 | 0.001–0.005 B |
| DE-A 25 37 819 | 0.5–1.5 | 0–0.5 | 0.005–0.4 | 0.4–1.2 | 0–0.3 | 0–0.5 | 0.05–0.5 | 0–0.05 | 0–0.005 B |
| DE-A 32 32 810 (= US-A 4 435 230) | 0.05–0.30 | up to 0.05 | — | 0.05–0.30 | — | — | 0.15–0.30 | up to 0.03 | up to 0.01 B |
| EP-A 0 067 056 | 0.11–0.14 | 0.01–0.13 | 0.004–0.01 | 0.002–0.02 | 0.01 | 0.01 | 0.33–1.31 | 0.01–0.03 | —[3] |
| | 0.16–0.54 | 0.05–0.15 | 0.02–1.02 | 0.03–1.15 | 0.01–0.02 | 0.01 | 0.39–0.76 | 0.03–0.16 | —[4] |
| EP-A 0 067 632 | 0.07–0.11 | 0.01 | 0.004–0.005 | 0.002–0.003 | 0.005–0.01 | 0.01 | 0.15–0.29 | 0.01–0.02 | —[3] |
| | 0.56 | 0.03 | 0.02 | 0.02 | 0.01 | 0.01 | 0.79 | 0.18 | —[4] |
| EP-A 0 096 347[5] | — | 0 to 2 | — | 0–0.6 | — | 0–0.30 | 0.20–1.00 | — | 0–0.05 Sn 0–0.06 In 0–0.03 Ga |
| EP-A 0 097 318 | 0.02–0.15 | up to 0.003 | up to 0.05 | up to 0.05 | — | up to 0.05 | 0.1–1.0 | up to 0.03 | — |

[1]maximum sum of the non-Al components: 0.5
[2]maximum sum of the non-Al components: 1.5
[3]as a single-layer material or as a top layer
[4]as the core in a multi-layer material
[5]Sn, In, Ga and/or Zn are present in amounts from 0.005 to 0.1

The particular advantages of each of the alloys and of the printing plate bases produced therefrom, are stated as being:

high stretchability coupled with permanent elongation after the stretching process, advantageous yield point relationship as a result of a low yield point and high strength, good dimensional stability of the printing plates during storage (German Auslegeschrift No. 1,160,639);

close fit when clamped on the printing cylinder; the clamped ends of the printing plates can readily be bent over (German Offenlegungsschrift No. 1,929,146);

improved resistance to fatigue, high tensile strength, good extensibility and high flexibility (German Offenlegungsschrift No. 2,537,819);

high resistance to fatigue coupled with a uniformly roughened surface (German Offenlegungsschrift No. 3,232,810) achieved by special production in the following stages: heat treatment at 450° to 600° C., hot-rolling, cold-rolling with reduction (deformation rate) of at least 70%, heating at 150° to 250° C. for at least 1 hour;

uniformly roughened surface, good mechanical properties during printing, even at high printing speeds, good dimensional stability even for relatively thin plates (European patent application No. 0,067,056) because the particle size of the intermetallic compounds is less than 3 μm, these being present directly below the outer surface of the hot-rolled, cold-rolled, heated and finally cold-rolled bases. Similar properties and production stages are also stated in European patent application No. 0,067,632;

better roughening properties and surface topography due to the presence of Sn, In, Ga and/or Zn in the alloy (European patent application No. 0,096,347); and better roughening properties and surface topography due to the reduction of the Cu content (European patent application No. 0,097,318).

Among the aluminum alloys listed above, in general those having a high Al content of more than 99.0%, in particular of at least 99.5%, are distinguished by good or very good roughening properties but are frequently not sufficiently thermally stable for use in modern procedures for processing printing plates to printing forms, i.e., they exhibit fatigue, for example, as a result of exposure to the high temperatures of more than 180° C., in particular more than 240° C., which are required during baking of positive-working reproduction layers. Although aluminum alloys having a low Al content frequently possess better thermal stability, they are generally inferior in their roughening properties, in particular in the uniformity of the surface topography.

Without any reference to the printing plate art, U.S. Pat. No. 3,989,548 describes aluminum alloy sheets with uniformly distributed intermetallic particles (compounds), the alloy containing at least two elements from the group comprising Fe, Ni, Mn and Si. At least 1.2% of Fe, 1.1% of Ni, 0.3% of Mn and 0.5% of Si must be present in the alloy in each case. The production procedure comprises casting the alloy with a particular growth rate at the solidification front and a particular temperature gradient in the liquid metal in the region of the solidification front. The cast alloy is subsequently subjected to hot and/or cold working with the aim of effecting a cross-sectional reduction of at least 60%. An Al-Fe-Mn alloy preferably has an Fe content of 1.4 to 2.0% and an Mn content of 0.3 to 1.2%, this special alloy furthermore containing Zn, Li, Cu, Mg and Si in a total amount of up to 1.5% and in individual amounts of not more than 1.0% in each case (individual component), as well as other elements, such as Ni, Cr, Co or B in a total amount of up to 1.0% and in individual amounts of not more than 0.3% in each case.

SUMMARY OF THE INVENTION

It is an object of the present invention to provide an aluminum alloy suitable as a base for printing plates which is at least equivalent to the better materials from the prior art in the quality of the surface topography after roughening, in particular after electrochemical roughening, but does not have their disadvantages during thermal treatment.

It is another object of the invention to provide an aluminum alloy, as above, which has a high Fe content and an Mn content which is also high for the amount of Fe present.

These objects are achieved by an aluminum alloy consisting essentially of aluminum, iron in an amount of from about 1.2% to about 2.1% by weight, and manganese in an amount of from about 0.1% to about 0.9% by weight, wherein the sum of the iron and manganese is from about 1.3% to about 2.2% by weight.

The objects are further achieved by a printing plate which comprises a base of the above alloy composition and having at least one radiation-sensitive applied on the base.

DETAILED DESCRIPTION OF THE PREFERRED EMBODIMENTS

The invention concerns bases for printing plates, which consist of an aluminum alloy containing iron (Fe) and manganese (Mn), the Fe content being greater than the Mn content. In the bases according to the invention, the Fe content is 1.2 to 2.1%, the Mn content is 0.1 to 0.9% and the sum of the Fe and Mn contents is 1.3 to 2.2%. In a preferred embodiment, the sum of the Fe and Mn contents is 1.5 to 2.2%. In another preferred embodiment, the Fe content is 1.45 to 1.6%, the Mn content is 0.35 to 0.5% and the sum of the Fe and Mn contents is 1.8 to 2.1%. Unless otherwise stated, all percentages are based on weight.

The invention furthermore relates to a printing plate which contains such a base and at least one radiation-sensitive reproduction layer which is applied on the base, the latter being present in a form which is mechanically, chemically and/or electrochemically roughened and, if appropriate, anodically oxidized and hydrophilized.

The aluminum alloy employed for the base according to the invention, which can be in web, sheet or foil form, can be produced, in particular, as described in German Pat. No. 2,423,597. In preparing the starting melt, it is advantageous to start from a eutectic alloy, with introduction of the alloy elements. To produce the cast alloy, the metal is cast so that there is essentially no nucleation of intermetallic particles in the molten metal before the front between the liquid and the solid metal. The term "eutectic alloy" in this context is also intended to denote a range of compositions of the alloys in the region of the eutectic points, in which it is possible to achieve simultaneous precipitation of the metallic aluminum phase and of one or more fiber-like intermetallic phases. After the cast alloy has been produced, it can be further processed by hot and/or cold working (e.g., rolling) and a cross-sectional reduction by at least 60% should be achieved.

In the production of rolled products, it is preferable to achieve the major part of cross-sectional reduction of the initial cast ingot by hot-rolling, further reduction then being effected by a subsequent cold-rolling process. In this context, "cold working" means working at a temperature of less than 250° C. Instead of the preferred ingot casting procedure at the beginning of alloy processing, it is also possible to carry out strip casting. For example, the cast alloy is heated to about 500° C., and hot-rolling of the ingot starts at this temperature and continues while the temperature decreases to about 260° to 330° C. During cold-rolling, the web thickness is reduced, for example, from a thickness of about 3.0 mm to a thickness of about 0.8 or about 0.3 mm. Cold-rolling can be followed, after intermediate annealing of the cold-rolled material at about 340° C., by renewed cold-rolling, during which the web which is about 0.8 mm thick, is likewise reduced to about 0.3 mm. In practice, the bases employed have a thickness of, in particular, from 0.1 to 0.5 mm, but may be thinner or thicker.

In addition to the elements Al, Fe and Mn listed above, the alloy can also contain Si, Mg, Ti and Zn, each in an amount preferably not more than 0.1%, and Cu, Ni and Co, each in an amount preferably not more than 0.3%. The sum of these elements preferably should not exceed 0.4%. Otherwise, the alloy employed according to the invention can furthermore contain the elements B, Be, Bi, Ca, Cr, Ga, Li, Na, Pb, Sb, Sn, V and/or Zr in a total amount of not more than 0.15% and in individual amounts of not more than 0.05%. The alloy employed according to the invention differs from the prior art in the field of bases for printing plates on the one hand, in that it has a high Fe content and an Mn content which is relatively high for an alloy having a high Fe content, and on the other hand in that the sum of the two components is high.

When used in practice, the bases for printing plates, preferably in web form or in sheet or foil form, are roughened mechanically (for example by means of brushes and/or treatment with abrasives), chemically (for example by means of etching agents) or electrochemically (for example by treatment with a.c. current in aqueous HCl or $HNO_3$ solutions) on one or both sides before the reproduction layer is applied. In particular, the bases are roughened mechanically and electrochemically or only electrochemically. The average peak-to-valley height $R_z$ of the roughened surface is in the range of from about 1 to 15 μm, in particular in the range of from 1.5 to 10 μm. The peak-to-valley height is determined in accordance with DIN 4768 in the October 1970 version, and the average peak-to-valley height $R_z$ is then the arithmetic mean of the individual peak-to-valley heights from five adjacent individual measuring zones.

Before the roughening procedure, preliminary cleaning of the sheet-like base can be performed. This comprises, for example, treatment with aqueous NaOH solution, with or without degreasing agents and/or complexing agents, trichloroethylene, acetone, methanol or other commercial so-called aluminum pickling agents. The roughening procedure may furthermore be followed by a treatment in which material is removed. In the case of a plurality of roughening stages, such a treatment may be carried out between the individual stages. In particular not more than 2 g/m$^2$ is removed (but up to 5 g/m$^2$ can be removed between stages). Solutions used for removing material are in general aqueous alkali metal hydroxide solutions or aqueous solutions of alkaline salts or aqueous acid solutions based on $HNO_3$, $H_2SO_4$ or $H_3PO_4$. In addition to a material-removing treatment stage between the roughening stage and any subsequent anodization stage, non-electrochemical treatments are also known which essentially have only a rinsing and/or cleaning action and serve, for example, for the removal of deposits ("smut") formed during the roughening procedure or simply for the removal of residues from the treatment procedure. Materials used for this purpose are, for example, dilute aqueous alkali metal hydroxide solutions or water.

The roughening procedure or procedures can, if required, be followed by an anodic oxidation of the base, in a further process stage to be employed, in order, for example, to improve the abrasion properties and adhesion properties of its surface or surfaces. For the anodic oxidation, conventional electrolytes such as $H_2SO_4$, $H_3PO_4$, $H_2C_2O_4$, amidosulfonic acid, sulfosuccinic acid, sulfosalicylic acid or mixtures of these, can be employed. In particular, $H_2SO_4$ and $H_3PO_4$ are used alone, as a mixture and/or in a multi-stage anodization process. The weights per unit area of an aluminum oxide layer vary in the range from 1 to 10 g/m$^2$, corresponding to a layer thickness of about 0.3 to 3.0 μm.

The stage consisting of anodic oxidation of the base may furthermore be followed by one or more post-treatment stages. In this context, post-treatment is understood as meaning, in particular, a hydrophilizing chemical or electrochemical treatment of the aluminum oxide layer, for example, treatment of the material by immersion in an aqueous polyvinylphosphonic acid solution according to British Published Application No. 1,230,447, treatment by immersion in an aqueous alkali metal silicate solution according to U.S. Pat. No. 3,181,461 or an electrochemical treatment (anodization) in an aqueous alkali metal silicate solution according to U.S. Pat. No. 3,902,976. These post-treatment stages serve, in particular, to effect a further increase in the often inadequate hydrophilicity of the aluminum oxide layer, the remaining known properties of this layer being at least retained.

Radiation-sensitive or photosensitive reproduction layers are understood in principle as meaning those which, after irradiation (exposure) and, if required, subsequent development and/or fixing, provide an image-bearing surface which can be used for printing.

In addition to the layers which contain silver halides and which are used in many fields, a variety of other layers are also known, such as those described in, for example, "Light-Sensitive Systems" by Jaromir Kosar, John Wiley & Sons Publishers, New York, 1965: the colloid layers containing chromates and dichromates (Kosar, chapter 2); the layers which contain unsaturated compounds and in which these compounds undergo isomerization, rearrangement, cyclization or cross-linking on exposure (Kosar, chapter 4); the layers which contain photopolymerizable compounds and in which monomers or prepolymers undergo polymerization on exposure, if necessary in the presence of an initiator (Kosar, chapter 5); and the layers containing o-diazoquinones, such as naphthoquinone diazides, p-diazoquinones or diazonium salt condensates (Kosar, chapter 7). The suitable layers also include the electrophotographic layers, i.e., those which contain an inorganic or organic photoconductor. In addition to the radiation-sensitive substances, these layers can of course also contain other components, such as, for example, resins, dyes or plasticizers.

In particular, the following radiation-sensitive materials or compounds can be employed in the reproduction layers:

positive-working reproduction layers which contain, as photosensitive compounds, o-quinone diazides, in particular o-naphthoquinone diazides, such as naphthoquinone-1,2-diazide-2-sulfonic acid esters or amides, which can have a low or high molecular weight, these reproduction layers being described in, for example, German Pat. Nos. 854,890, 865,109, 879,203, 894,959, 938,233, 1,109,521, 1,144,705, 1,118,606, 1,120,273, 1,124,817 and 2,331,377, and European patent application Nos. 0,021,428 and 0,055,814;

negative-working reproduction layers containing condensates of aromatic diazonium salts and compounds possessing active carbonyl groups, preferably condensates of diphenylamine diazonium salts and formaldehyde, which are described in, for example, German Pat. Nos. 596,731, 1,138,399, 1,138,400, 1,138,401, 1,142,871 and 1,154,123, U.S. Pat. Nos. 2,679,498 and 3,050,502 and British Published application No. 712,606;

negative-working reproduction layers, for example according to German Pat. No. 2,065,732, which contain co-condensates of aromatic diazonium compounds. These reproduction layers contain products possessing at least one unit of (a) condensable aromatic diazonium salt compound and (b) at least one unit of a condensable compound, such as a phenol ether or an aromatic thioether, bonded by an intermediate member such as a methylene group, which possesses two bonds and is derived from a condensable carbonyl compound;

positive-working layers according to German Offenlegungsschriften Nos. 2,610,842, 2,718,254 or 2,928,636, which contain a compound which eliminates an acid on irradiation, a monomeric or polymeric compound which has at least one C—O—C group which can be eliminated by means of an acid (for example an orthocarboxylate group or a carboxamide-acetal group) and, if required, a binder;

negative-working layers consisting of photopolymerizable monomers, photoinitiators, binders and, if required, further additives. The monomers used are, for example, acrylates or methacrylates or reaction products of diisocyanates with partial esters or polyhydric alcohols, as described in, for example, U.S. Pat. Nos. 2,760,863 and 3,060,023 and German Offenlegungsschriften Nos. 2,064,079 and 2,361,041;

negative-working layers according to German Offenlegungsschrift No. 3,036,077 which contain, as a photosensitive compound, a diazonium salt polycondensate or an organic azido compound, and as a binder, a high molecular weight polymer possessing alkenylsulfonyl or cycloalkenylsulfonylurethane side groups.

Photosemiconductive layers, as described in, for example, German Pat. Nos. 1,117,391, 1,522,497, 1,572,312, 2,322,046 and 2,322,047, can also be employed.

For the printing plate sector, the bases according to the invention have properties which are superior to the qualities of the prior art. They are, in particular, thermally stable and at the same time exhibit, even after a roughening procedure, preferably after electrochemical roughening, surface topography which conforms to practice and meets the requirements of modern high-performance printing plates. In the case of the aluminum alloys used and/or described to date in the lithography art, it has been impossible hitherto to achieve this combination of properties. These properties offer particular advantages in the production of printing plates possessing positive-working reproduction layers which are often baked in order to achieve longer print runs, i.e., the exposed and developed printing plate is heated to a temperature of more than 180° C. before being used for printing, in order to render the image areas more resistant. When these printing plates have a base possessing the alloy composition according to the invention, the base exhibits fewer problems with respect to strength after the baking procedure.

The radiation-sensitive layer applied onto the base according to the invention is either a negative-working layer which contains a reaction product of polyvinylbutyral with propenylsulfonyl isocyanate, a polycondensate of 1 mole of 3-methoxydiphenylamine-4-diazonium sulfate and 1 mole of 4,4'-bismethoxymethyldiphenyl ether precipitated as the mesitylenesulfonate, $H_3PO_4$, Victoria Pure Blue FGA and phenylazodiphenylamine, or a positive-working layer which contains a cresol/formaldehyde novolak, 4-(2-phenyl-prop-2-yl)-phenyl ester of 1,2-naphthoquinone-2-diazide-4-sulfonic acid, polyvinylbutyral, 1,2-naphthoquinone-2-diazide-4-sulfonyl chloride and crystal violet. Suitable printing plates and printing forms can be produced utilizing the radiation-sensitive layer.

EXAMPLE 1

An aluminum alloy web produced by a manufacturing process involving ingot casting, hot-rolling and cold-rolling and containing 1.6% of Fe and 0.35% of Mn (the amount of the remaining alloy elements being not more than 0.3% with the remainder aluminum) was degreased in an aqueous NaOH solution, roughened electrochemically in an aqueous solution containing 0.9% of HCl, using a.c. current (115 A/dm$^2$ at 35° C.), and anodically oxidized in an aqueous solution containing $H_2SO_4$ and $Al^{3+}$ ions, using d.c. current.

COMPARATIVE EXAMPLE V1

The procedure described in Example 1 was followed, except that the starting material employed was a web consisting of the aluminum alloy "pure aluminum" (or "1050") (containing 0.4% of Fe and virtually no Mn).

COMPARATIVE EXAMPLE V2

The procedure described in Example 1 was followed, except that the starting material employed was a web consisting of the aluminum alloy "1100" (containing 0.375% of Fe and virtually no Mn).

COMPARATIVE EXAMPLE V3

The procedure described in Example 1 was followed, except that the starting material employed was a web consisting of the aluminum alloy "3003" (containing 0.15% of Fe and 0.7% of Mn).

EXAMPLE 2

The procedure described in Example 1 was followed, except that the starting material employed was a web consisting of an aluminum alloy containing 1.6% of Fe and 0.5% of Mn (the amount of the remaining alloy elements being not more than 0.35% and the remainder aluminum).

EXAMPLE 3

The procedure described in Example 1 was followed, except that the starting material was a web consisting of an aluminum alloy containing 1.5% of Fe and 0.5% of Mn (the amount of the remaining elements being not more than 0.35% and the remainder aluminum).

EXAMPLE 4

The procedure described in Example 1 was followed, except that the starting material employed was a web consisting of an aluminum alloy containing 1.45% of Fe and 0.5% of Mn (the amount of the remaining elements being not more than 0.3% and the remainder aluminum).

EXAMPLE 5

The procedure described in Example 1 was followed, except that the starting material employed was a web consisting of an aluminum alloy containing 1.45% of Fe and 0.35% of Mn (the amount of the remaining elements being not more than 0.3% and the remainder aluminum).

RESULTS

Topography After Roughening

The topography after roughening was the most uniform (i.e., uniformity of hole distribution, little if any pits) in the case of V1 and Examples 1 to 5 according to the invention. In the case of V2 and V3, the quality was already substantially poorer.

Mechanical Properties After Heating

To investigate the mechanical properties after heating as a function of temperature, the yield point and the tensile strength were determined at room temperature and at certain temperature intervals between 100° and 300° C.

In the case of the yield point and the tensile strength, the values for the bases according to the invention were comparable with those for V3. The values for V1 and V2 were substantially below these values.

What is claimed is:

1. A printing plate produced by a process comprising the steps of:

(a) providing an aluminum alloy base material in the form of a web, sheet or foil, said base material consisting essentially of, on a total weight basis, iron in an amount of from 1.2% by weight to about 2.1% by weight, manganese in an amount of from about 0.1% by weight to about 0.9% by weight, impurities in an amount up to a sum of maximum 0.4% by weight, the remainder being aluminum, the sum of the iron and the manganese being between about 1.3% by weight and about 2.2% by weight;

(b) roughening said base material by means of at least one of a mechanical, chemical and electrochemical process to thereby give a peak-to-valley height in the range of from about 1 to 15 $\mu$m; and (c) providing at least one radiation-sensitive reproduction layer over said base material.

2. A printing plate as claimed in claim 1, wherein roughening of said base material is followed by anodic oxidation.

3. A printing plate as claimed in claim 2, wherein said anodic oxidation is followed by an hydrophilizing chemical or electrochemical treatment of said base.

4. A printing plate as claimed in claim 1, including the step of preliminary cleaning prior to said roughening step.

* * * * *